US010626887B2

(12) United States Patent
Schmetz et al.

(10) Patent No.: US 10,626,887 B2
(45) Date of Patent: Apr. 21, 2020

(54) PORTABLE INFLATION DEVICE

(71) Applicant: NIC IMPEX, Annecy (FR)

(72) Inventors: Jean-Michel Schmetz, Kettenis (BE); Nicolas Navez, Villaz (FR); Patrick Giraudon, Veyrier-du-Lac (FR)

(73) Assignee: NIC IMPEX (FR)

( * ) Notice: Subject to any disclaimer, the term of this patent is extended or adjusted under 35 U.S.C. 154(b) by 68 days.

(21) Appl. No.: 15/746,578

(22) PCT Filed: Jul. 12, 2016

(86) PCT No.: PCT/FR2016/051782
§ 371 (c)(1),
(2) Date: Apr. 18, 2018

(87) PCT Pub. No.: WO2017/013327
PCT Pub. Date: Jan. 26, 2017

(65) Prior Publication Data

US 2018/0283407 A1 Oct. 4, 2018

(30) Foreign Application Priority Data

Jul. 23, 2015 (FR) ..... 15 57000

(51) Int. Cl.
*F04F 5/18* (2006.01)
*A62B 33/00* (2006.01)
(Continued)

(52) U.S. Cl.
CPC ..... *F04F 5/18* (2013.01); *A62B 33/00* (2013.01); *A63B 29/02* (2013.01); *F04F 5/466* (2013.01); *F04F 5/48* (2013.01); *F04F 5/50* (2013.01)

(58) Field of Classification Search
CPC ..... F04F 5/18; F04F 5/466; F04F 5/48; F04F 5/50; A62B 33/00
(Continued)

(56) References Cited

U.S. PATENT DOCUMENTS 3,370,784 A 2/1968 Day
3,468,472 A 9/1969 Hahn
(Continued)

FOREIGN PATENT DOCUMENTS

EP 2 548 619 A2 1/2013

OTHER PUBLICATIONS

International Search Report (with English translation) dated Oct. 7, 2016 for International Application No. PCT/FR2016/051782.
(Continued)

*Primary Examiner* — Timothy L Maust
(74) *Attorney, Agent, or Firm* — Fay Sharpe LLP

(57) ABSTRACT

A portable device for inflating at least one envelope includes an inlet for surrounding air (1), at least one nonreturn valve, at least one compressed gas inlet (2), at least one intake chamber (3), at least one connection, such as an acceleration cone (5), with a longitudinal median symmetry axis (X, X'), arranged in the extension of at least one intake chamber (3), and connected to at least one inflatable envelope, and an intermediate chamber connecting at least one compressed gas inlet (2) to at least one intake chamber (3). The intermediate chamber and the at least one intake chamber (3) are separated by a wall arranged transversely to the axis (X, X') and connected by at least one orifice located in the transverse wall (8).

19 Claims, 5 Drawing Sheets

(51) Int. Cl.

| | |
|---|---|
| ***F04F 5/48*** | (2006.01) |
| ***A63B 29/02*** | (2006.01) |
| ***F04F 5/46*** | (2006.01) |
| ***F04F 5/50*** | (2006.01) |

(58) Field of Classification Search
USPC ..... 141/329, 330
See application file for complete search history.

(56) References Cited

U.S. PATENT DOCUMENTS

| | | | | |
|---|---|---|---|---|
| 3,875,745 | A * | 4/1975 | Franklin | F01N 3/05 60/319 |
| 4,566,862 | A | 1/1986 | Halavais | |
| 6,220,909 | B1 | 4/2001 | Aschauer et al. | |
| 7,878,141 | B2 * | 2/2011 | Paynton | A62B 33/00 116/210 |
| 9,814,938 | B2 * | 11/2017 | Schaer | A62B 33/00 |
| 2005/0130516 | A1 | 6/2005 | Courtney | |
| 2013/0019994 | A1 | 1/2013 | Schaer et al. | |
| 2013/0283510 | A1 | 10/2013 | Berchten et al. | |
| 2018/0140875 | A1 * | 5/2018 | Navez | A62B 33/00 |

OTHER PUBLICATIONS

Written Opinion (with English translation) dated Oct. 7, 2016 for International Application No. PCT/FR2016/051782.
International Preliminary Report on Patentability (with English explanation) dated Jan. 23, 2018 for International Application No. PCT/FR2016/051782.

* cited by examiner

PORTABLE INFLATION DEVICE

The present invention relates to a portable device for inflating an envelope during the onset of an avalanche.

According to a provisional assessment of avalanche accidents in France in the 2013-2014 season, about a third of accidents are fatal accidents, about one third of people were buried and one-fifth of the people involved died. These accidents come from activities related to mountaineering, off-piste (backcountry) skiing and ski touring.

These devices operate by triggering an inflatable airbag envelope that allows the endangered user to reduce the severity of or prevent being buried. The use of these devices in extreme situations reduces the likelihood that an avalanche accident will turn into a fatal accident.

These devices are accessible, and more and more users are equipped with them. These devices are usually built into backpacks.

An airbag-type envelope is generally inflated by surrounding air suction, by a joint supply of compressed gas, commonly accelerated by the venturi effect, as described in documents U.S. Pat. No. 6,220,909, US 2013/0283510 and EP 2 548 619.

Documents U.S. Pat. No. 6,220,909 and US 2013/0283510 disclose a venturi system consisting of a compressed gas ejection nozzle, drawing the surrounding air through a lateral inlet of an acceleration cone.

EP 2 548 619 describes a device of a substantially cylindrical structure, drawing the surrounding air at one end for inflating an envelope at the other end, via an acceleration cone. The surrounding air suction is accelerated by the venturi effect. This venturi effect is achieved by the injection of compressed gas into an intermediate distribution chamber, opening into a side wall of an air intake chamber by ejection holes. The intermediate distribution chamber is located at the periphery of the air intake chamber.

Ideally, a portable inflating device of an airbag-type envelope must allow the inflation of the envelope in any situation, in particular under stress, such as under the constraint of the weight of the user in distress, under the constraint of snow scree, and in contact with the environment, such as rocks.

Unfortunately, the majority of existing devices do not have a push-off strength, namely a system inflating power, sufficient for a complete inflation of the envelope in case of unfavorable positioning of the user in an avalanche at the time of the inflation, resulting in partial inflation of the envelope. This unfavorable position causes inflation-opposing constraints which may be, for example, the weight of the user or the avalanche snow.

The present invention therefore proposes portable inflating devices having a significant strength, allowing inflation of one or more envelopes under duress significantly greater than existing devices.

Thus, a portable device for inflating at least one envelope, according to the invention, comprises an inlet for surrounding air, at least one non-return valve, at least one compressed gas inlet, at least one inlet chamber, at least one connection, such as an acceleration cone, comprising a longitudinal median symmetry axis, arranged in the extension of at least one intake chamber, and connected to at least one inflatable envelope, an intermediate chamber connecting at least one compressed gas inlet to at least one intake chamber, while an intermediate chamber and at least one intake chamber are separated by a wall arranged transversely to the longitudinal median symmetry axis of the connection, and connected by at least one orifice located in the wall of the intermediate chamber.

It should be added that the transverse wall of the intermediate chamber is formed by an annular peripheral rib, extending to an inner wall of at least one intake chamber.

Note that at least one orifice is constituted by a passage, made by a cutout in the transverse wall of the intermediate chamber, while the cutout is passing through in the transverse wall of the intermediate chamber, and opens outwards around the periphery.

It should be pointed out that the intermediate chamber comprises an inner side face of a wall fitting a sidewall of an inlet for surrounding air, an outer side face of a wall comprising at least one compressed gas inlet, and a transverse face arranged in the extension of a transverse outer face of an inner wall, of at least one intake chamber.

According to one embodiment, the transverse wall of the intermediate chamber comprises an outer peripheral face, while the transverse outer face and the inner face of the inner wall of at least one intake chamber form an edge that comes to end together against the outer peripheral face of the transverse wall of the intermediate chamber.

According to the preceding embodiment, the peripheral outer face of the transverse wall of the intermediate chamber has an incline of between 5 and 15 degrees, while the inner face of the inner wall of at least one intake chamber has an incline between 0 and 15 degrees.

More specifically, the peripheral outer face of the transverse wall of the intermediate chamber has an incline of between 9 and 13 degrees, while the inner face of the inner wall of at least one intake chamber has an incline of between 0 and 10 degrees.

According to the preceding embodiment, at least one orifice is arranged in the transverse wall of the intermediate chamber opening at the edge formed by the transverse outer face and the inner face of the inner wall of at least one intake chamber.

According to one characteristic, an intermediate chamber is located at the periphery of an inlet for surrounding air.

It should be noted that one intermediate chamber is arranged in the rear position of at least one intake chamber.

Other characteristics and advantages of the invention will become apparent from the description which follows, with reference to the accompanying drawings which are given by way of non-limiting examples.

FIG. 1 is a longitudinal, sectional view of the device.

FIG. 2 is a view of a magnification of FIG. 1.

FIG. 3 is an exploded perspective view of a portion of the device parts.

FIG. 4 is a perspective view of the rear part of the device.

FIG. 5 is a longitudinal, sectional view of the device.

FIG. 6 is a magnification of FIG. 5.

FIG. 7 is a longitudinal, sectional magnification at the level of an orifice.

FIG. 8 is an exploded perspective view of one portion of the parts of the device.

FIG. 9 is a longitudinal, sectional magnification at the level of an orifice.

FIG. 10 is an exploded perspective view on portion of the parts of the device.

Figure 1:
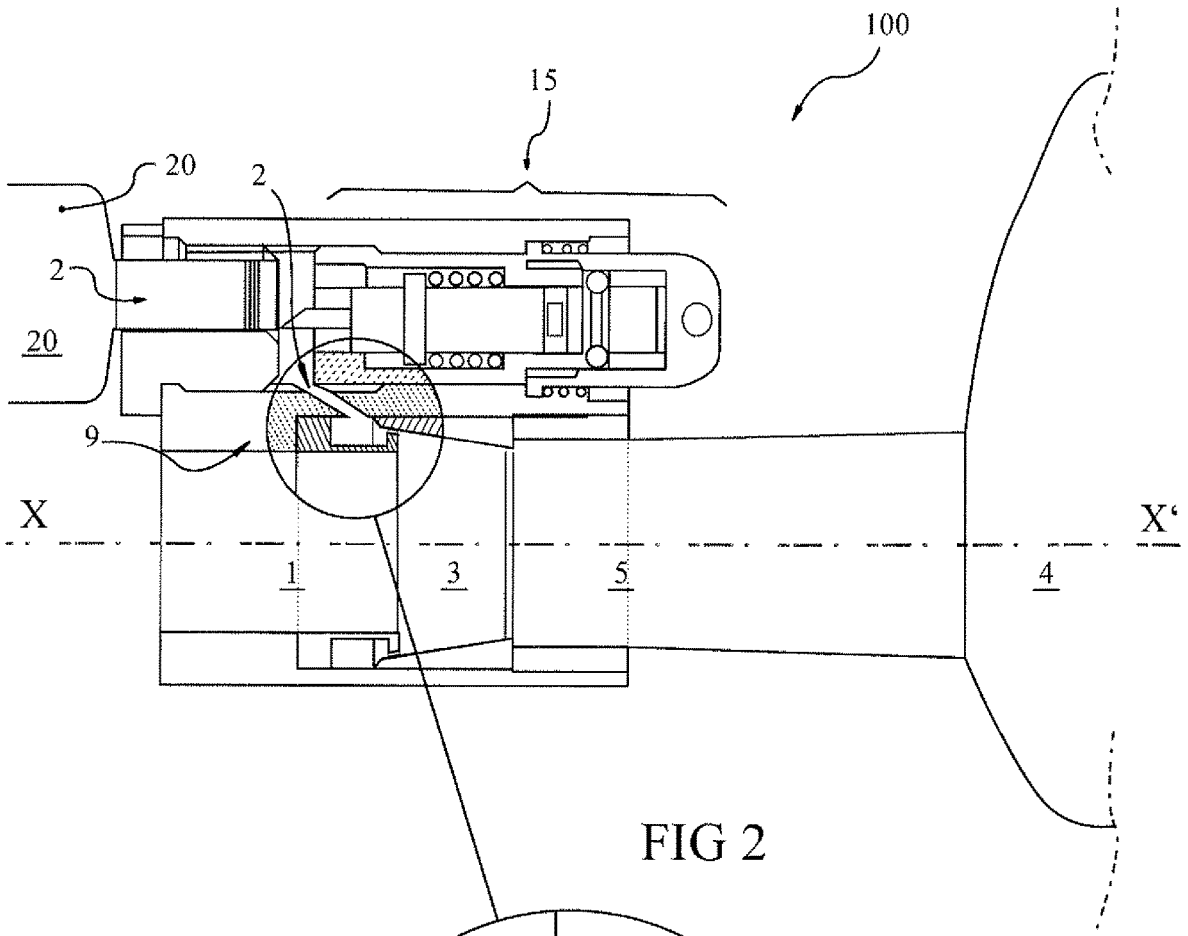
FIGS. 1 to 4 are views of the device according to one embodiment of the invention.
Figure 5:
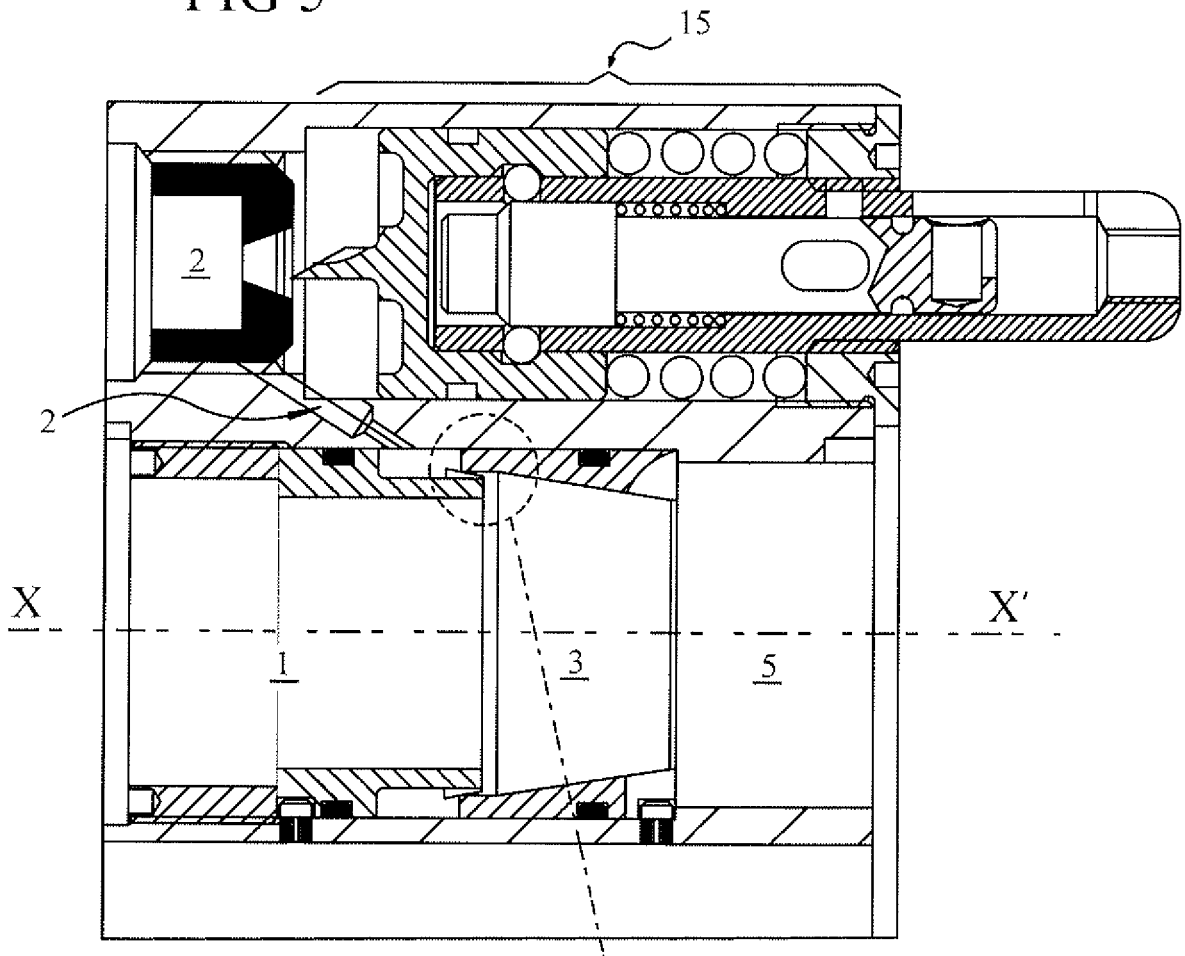
FIGS. 5 to 8 are views of the device according to another embodiment of the invention.

Thus, the device (100) according to the invention, as illustrated in FIGS. 1 and 5, is in a substantially cylindrical form and comprises, in substantially the same section, an inlet for surrounding air (1), at least one intake chamber (3), and at least one connection, such as an acceleration cone (5) opening into at least one inflatable envelope (4). An intermediate chamber (6) is located at the periphery of an inlet for surrounding air (1) and opens into at least one intake chamber (3) through at least one orifice (7), preferably orifices (7) regularly spaced, located in a wall (8) of an intermediate chamber (6).

It is understood as an inlet for surrounding air (1), the zone precedes at least one inlet chamber (3). At least one opening, arranged in a lateral position or longitudinally, supplies the air inlet (1) with surrounding air.

A connection, such as an acceleration cone (5), is in some embodiments partitioned into a number of acceleration cones (5).

An intermediate chamber (6) is, according to other embodiments, represented by a number of intermediate chambers (6) advantageously contiguous, advantageously at the periphery of an inlet for surrounding air (1), and fed by a number of compressed gas inlets (2). In the following description, reference will be made to an intermediate chamber (6) for a number of intermediate chambers (6), as explained above.

Note that at least one non-return valve advantageously closes the inlet for surrounding air (1) or each of the openings supplying the latter, namely at least one opening arranged as explained above, and/or an internal part of the device, such as between the junction of at least one intake chamber (3) and one acceleration cone (5), and/or at the inlet of at least one envelope (4).

It should be noted that at least one compressed gas inlet (2) communicates with at least one intake chamber (3) via an intermediate chamber (6).

At least one intake chamber (3) is located in front of one intermediate chamber (6). At least one compressed gas inlet (2) is located at the periphery of one intermediate chamber (6). A canister (20) of compressed gas and a firing pin as a triggering system (15) are connected to at least one compressed gas inlet (2). The triggering system is itself connected to an activation handle (not shown).

It is understood that the front or rear corresponds to the positioning of one part or of one zone, according to the direction of the fluid, for example the inlet for surrounding air (1) is arranged at the back of the intake chamber (3), which is itself located in front of the intermediate chamber (6).

It is also understood that at least one portion of an intermediate chamber (6) and at least a portion of at least one intake chamber (3) are aligned along the same longitudinal axis and advantageously share the same cross section. As previously stated, this cross section is represented by the wall (8) of the intermediate chamber (6).

Thus, the compressed gas is injected by at least one compressed gas inlet (2), passes through an intermediate chamber (6), opens into at least one intake chamber (3) through at least one orifice (7) and creates a depression which causes a suction phenomenon of the surrounding air, via a an inlet for surrounding air (1) by at least one opening, to an acceleration cone (5) for inflating at least one envelope (4). At least one intake chamber (3) thus corresponds to an enriched gas zone.

The injection of compressed gas is accelerated by the venturi effect, which increases the suction phenomenon of the surrounding air. This following process allows the inflation of at least one envelope (4) with a relatively small volume of compressed gas.

An orifice (7) is advantageously represented by any means allowing a sectional narrowing of an intermediate chamber (6) at a transverse wall (8), allowing acceleration of the compressed gas in at least one intake chamber (3).

According to one embodiment, as illustrated in FIGS. 1 and 5, one inlet for surrounding air (1), one intake chamber (3) and one acceleration cone (5) are arranged substantially according to the same profile, along a median symmetry axis (X, X').

Thus, the section of the device being preferably cylindrical, reference will be made, in particular for an intermediate chamber (6), to a wall or an inner side face for a wall or a face of a smaller section, and a wall or an outer side face for a wall or a face of larger section, arranged on the periphery of that of smaller section.

More generally, reference will be made to the terms inside and outside, for elements or parts of elements, near and distant, respectively to the axis (X, X').

Reference will also be made to a wall or a lateral face for a wall, or a face at the periphery of the axis (X, X'), a longitudinal axis for an axis parallel to the axis (X, X'), and a wall or a transverse face for a wall, or a face arranged perpendicularly to the axis (X, X').

According to embodiments, as illustrated in FIGS. 1, 2, 5, 6, 7 and 9, an intermediate chamber (6) comprises an inner side face of a wall fitting a side wall (9) of an inlet for surrounding air (1), an outer side wall surface comprising at least one compressed gas inlet (2), and a transverse wall face (8) adjacent to an intake chamber (3).

Figure 2:
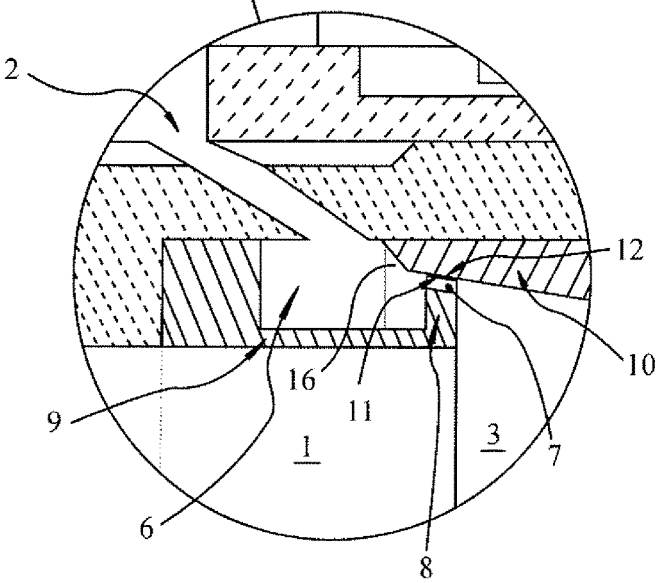
Figure 6:
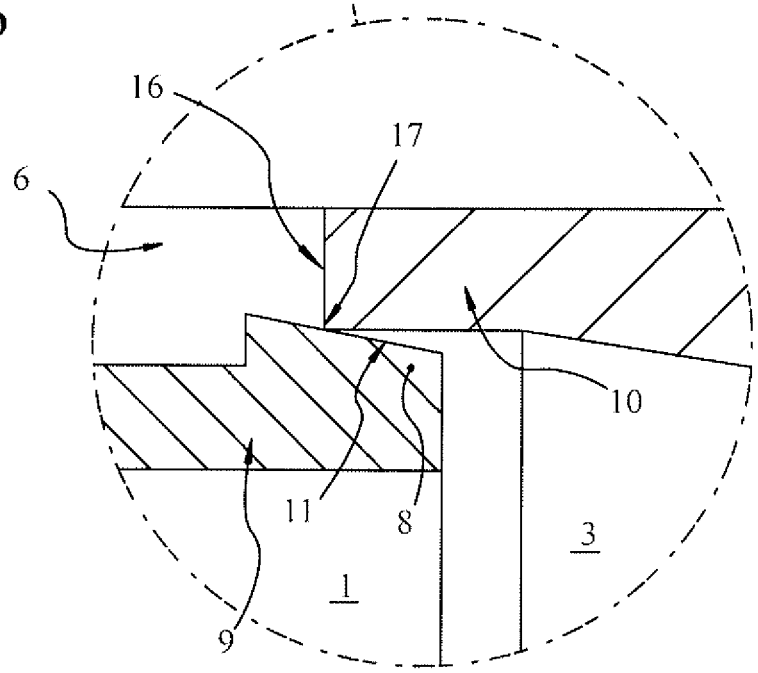

According to embodiments, as illustrated in FIGS. 2 and 6, the transverse wall (8) is formed by an annular peripheral rib extending as far as the inner wall (10) of the intake chamber (3).

According to the embodiment illustrated in FIG. 2, the transverse face of the wall (8) is extended by the transverse outer face (16) of the inner wall (10) of the intake chamber (3). It should be noted that at least one orifice (7) is delimited by an outer peripheral face (11) corresponding to the outer face of the wall (8), namely the outer face of the annular peripheral rib, and by an inner peripheral face (12) corresponding to the extension of the inner face of the inner wall (10) of the intake chamber (3).

It is understood that the transverse face of the wall (8) and the transverse outer face (16) can be inclined. It is also understood that the inclines of the different faces may be different. For the sake of brevity, an inclined wall (8) is considered as being transverse in the description, without departing from the scope of the invention.

It should be added that according to one embodiment, the outer peripheral face (11) and the inner peripheral face (12) are advantageously complementary and arranged in opposition. In other words, at least one orifice (7) consists of a passage made by a cutout at the outer peripheral face (11) of the transverse wall (8), said cutout crossing the transverse wall (8) and opening out towards the periphery, but it could be otherwise, at least one orifice (7) is advantageously made in the full transverse wall (8) of the intermediate chamber (6).

According to some embodiments, these open cutouts, namely the orifices (7) are advantageously regularly spaced on the projecting rib, and advantageously comprise between 1 and 20, preferably between 1 and 12.

According to some preferred embodiments, as illustrated in FIGS. 5 and 6, the transverse outer face (16) of the inner wall (10) of the intake chamber (3) is arranged upright and at the end of the outer peripheral face (11) corresponding to the outer face of the wall (8). Thus the transverse outer face (16) and the inner face of the inner wall (10) form an edge (17) which comes to be assembled at the end together against the outer peripheral face (11) of the wall (8).

Figure 9:
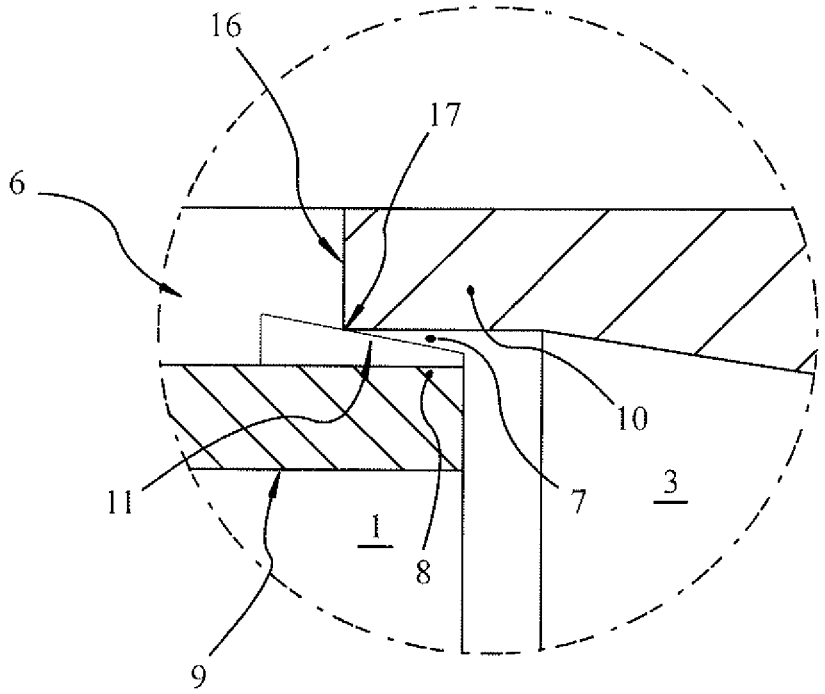
FIGS. 9 and 10 are views of the device according to another embodiment of the invention.

According to one of the preceding preferred embodiments, as illustrated in FIG. 9, at least one orifice (7) is arranged in the wall (8) opening at the edge (17). This particular configuration forms injection orifices at the intermediate chamber (6) opening towards the inner periphery of the inlet chamber (3), corresponding to an ejection profile at an advantageously triangular section delimited by the outer peripheral face (11) and the inner face of the inner wall (10). Preferably, at least one orifice (7) is represented by a narrowing ending in a section of small diameter, opening towards the intake chamber (3) at the edge (17).

Figure 8:
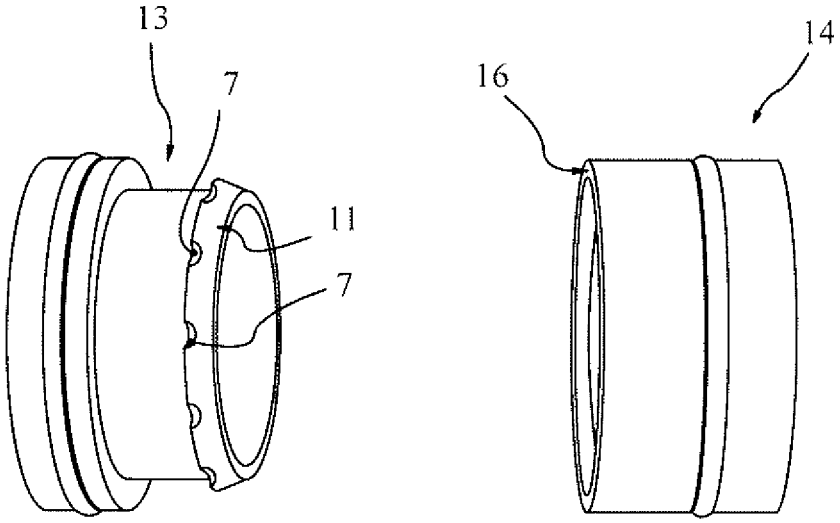
Figure 10:
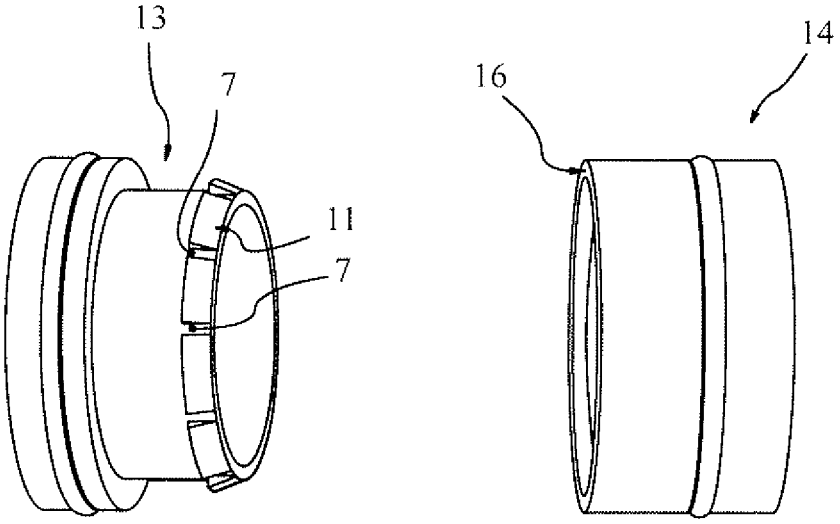

At least one orifice (7) represented by a narrowing ending in a small diameter section is advantageously achieved by a partial drilling method, as illustrated in FIG. 8 and by a continuous drilling method, as illustrated in FIGS. 9 and 10.

More specifically, the slope of the outer peripheral face (11) is between 5 and 15 degrees, preferably between 9 and 13 degrees, while the slope of the inner face of the inner wall (10) is between 0 and 15 degrees, preferably between 0 and 10 degrees, more preferably composed of a first rear portion at 0 degrees, namely arranged parallel to the axis (X, X') and a second portion at between 0 and 10 degrees, as illustrated in FIG. 5.

These particular configurations make it possible to obtain a significant inflating power, creating an inflation push-off strength that is significantly greater than existing devices.

Figure 3:
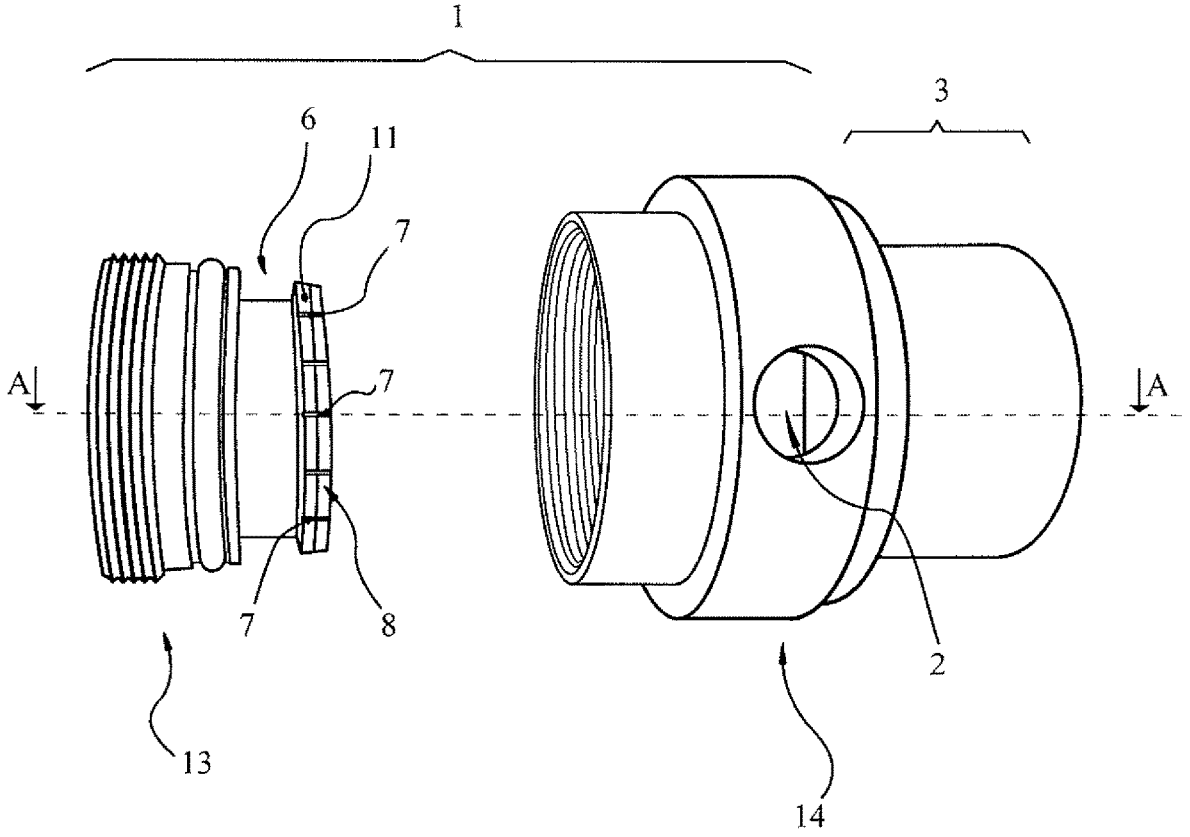

The device (100) according to the invention, preferably consists of different interlocking parts, as illustrated in FIGS. 3, 8 and 10. The different parts each represent a characteristic element of the invention, such as those representing the inlet for surrounding air (1), at least one intake chamber (3) and the intermediate chamber (6).

The interlocking of the parts is advantageously carried out by sliding or screwing into each other.

The various parts advantageously comprise threading and tappings, or interlocking parts, adapted to their cooperation.

FIGS. 3, 8 and 10 illustrate embodiments and represent, on the one hand, a first part that will be called a rear part (13) whose elements are characteristic of at least the inlet for surrounding air (1) and the intermediate chamber (6), and on the other hand, a second part that will be called a front piece (14), the elements of which are characteristic of at least one intake chamber (3).

Parts (13, 14), according to the embodiment illustrated in FIG. 3, are complementary sleeves.

Figure 4:
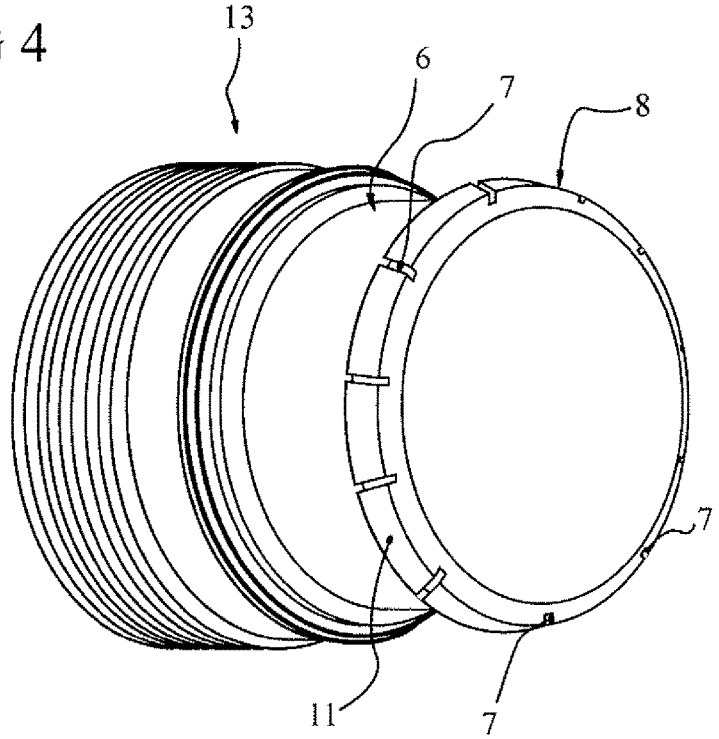

FIG. 3 illustrates a rear part (13) having a threading at one of its ends, followed by a circumferential bore adapted to contain a gasket, a clearance corresponding to a first inner part of the intermediate chamber (6) and an interlocking joint portion including an outer peripheral surface (11) at its other end. The outer peripheral surface (11) of the interlocking connecting portion comprises clearances corresponding to the inner portions of the orifices (7), as illustrated in FIG. 4.

FIG. 3 also illustrates a front piece (14), which has a tapping at one of its ends, adapted to cooperate with the threading of the rear piece (13), an annular portion corresponding to the second outer portion of the intermediate chamber (6), comprising a through bore, adapted to correspond to the compressed gas inlet (2), an interlocking joint portion, complementary to that of the part rear (13), comprising an inner peripheral surface (12) adapted to conform to the outer peripheral surface (11) of the rear part (13), followed by a substantially cylindrical part, of an inner surface (10) corresponding to the intake chamber (3).

Note that a portion of the inner peripheral surface (12) corresponds to the outer portions of the orifices (7).

Thus, at least one orifice (7) allowing acceleration of the compressed gas, by venturi effect, is advantageously located at the junction of these two parts (13, 14), preferably represented by at least one clearance at the outer peripheral surface (11) of the rear piece (13), but as has already been pointed out, it could be otherwise, at least one orifice (7) is advantageously made in the full wall (8).

At least one orifice (7) is advantageously represented by a clearance in the form of a rectilinear passage or by a narrowing ending in a small diameter section.

According to one embodiment, as shown in FIG. 3, the rear part (13) fits substantially entirely inside the front piece (14), sliding at one end, preferably at the level of the wall (8) and screwing at its other end.

Figure 7:
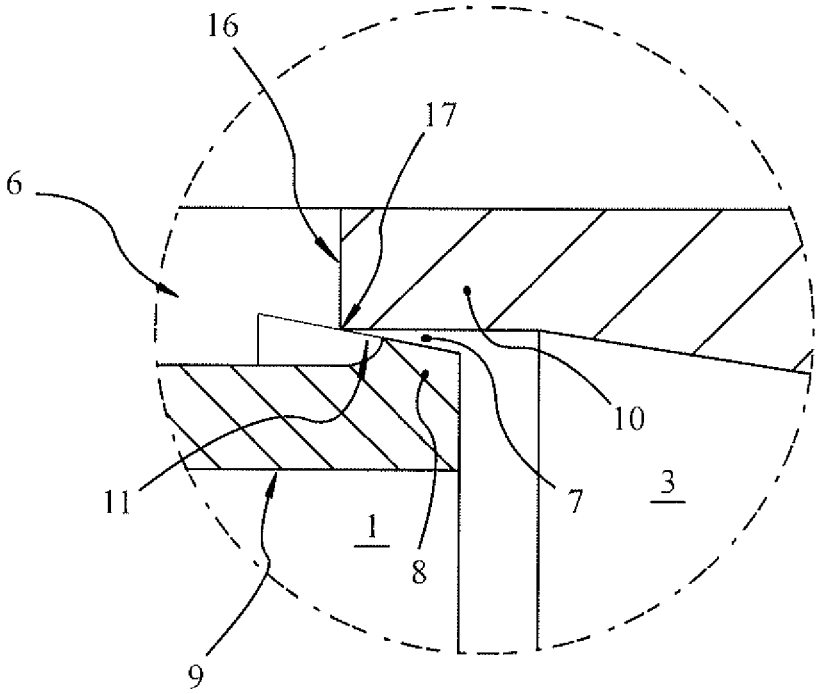

FIGS. 8 and 10 illustrate preferred embodiments, in which a rear piece (13) comprises an interlocking joint portion at one of its ends, namely the front end, followed by a circumferential bore adapted to contain a gasket and a clearance corresponding to a first inner portion of the intermediate chamber (6). The interlocking joint portion comprises an outer peripheral surface (11). The outer peripheral surface (11) of the interlocking joint portion includes clearances corresponding to the inner portions of the orifices (7), as illustrated in FIGS. 7 and 9.

FIGS. 8 and 10 also illustrate a front piece (14), which comprises an interlocking joint portion at one of its ends, namely the rear end, adapted to cooperate with the front end of the rear piece (13). The rear end of the front piece (14) consists of a transverse outer face (16). The joint of the latter with the inner face of the inner wall (10) forms an edge (17). The rear end of the front piece (14) is followed by a substantially cylindrical portion, consisting of an inner face of the inner wall (10), corresponding to the air intake chamber (3).

The device also comprises, according to this latter embodiment, an additional part comprising the compressed gas inlet (2) and the triggering system (15). The compressed gas inlet (2) partitions the intermediate chamber (6) at the outer portion of the rear piece (13). A complementary piece advantageously fits at the end of the rear end of the rear piece (13), keeping in contact the various parts assembled by interlocking, as illustrated in FIG. 5.

The compressed gas is advantageously any gas commonly compressed in a canister (20) or a cartridge, such as carbon dioxide, nitrogen, argon and air.

The invention claimed is:

1. A portable device (100) for inflating at least one inflatable envelope (4) during onset of an avalanche, said device (100) built into a backpack and comprising:

an inlet for surrounding air (1), at least one non-return valve, at least one compressed gas inlet (2), at least one intake chamber (3), at least one connection located along a longitudinal median symmetry axis (X, X'), arranged as an extension of the at least one intake chamber (3), and connected to the at least one inflatable envelope (4), an intermediate chamber (6) connecting at least one compressed gas inlet (2) to the at least one intake chamber (3), wherein the intermediate chamber (6) and the at least one intake chamber (3) are separated by a wall (8) arranged transversely to the axis (X, X') and are connected by at least one orifice (7) located in said wall (8).

2. The device (100) according to claim 1, wherein the wall (8) is formed by an annular peripheral rib, extending to an inner wall (10) of the at least one intake chamber (3).

3. The device (100) according to claim 1, wherein the at least one orifice (7) comprises a passage made by a cutout in a periphery of the wall (8).

4. A device (100) for inflating at least one inflatable envelope (4), said device (100) comprising:

an inlet for surrounding air (1);

at least one non-return valve;

at least one compressed gas inlet (2);

at least one intake chamber (3);

at least one connection located along a longitudinal median symmetry axis (X, X'), arranged as an extension of the at least one intake chamber (3), and connected to the at least one inflatable envelope (4);

an intermediate chamber (6) connecting at least one compressed gas inlet (2) to the at least one intake chamber (3);

wherein the intermediate chamber (6) and the at least one intake chamber (3) are separated by a wall (8) arranged transversely to the axis (X, X') and are connected by at least one orifice (7) located in said wall (8); and wherein the intermediate chamber (6) comprises an inner side face of a wall joining a side wall (9) of the an inlet for surrounding air (1), an outer lateral face of one wall comprising at least one compressed gas inlet (2), and a transverse face of the wall (8) arranged in an extension of a transverse outer face (16) of an inner wall (10) of the at least one intake chamber (3).

5. The device (100) according to claim 4, wherein the wall (8) comprises an outer peripheral face (11), while the transverse outer face (16) and the inner face of the inner wall (10) form an edge (17) which is assembled at the end against an outer peripheral face (11) of the wall (8).

6. The device (100) according to claim 5, wherein the outer peripheral face (11) has an incline of between 5 and 15 degrees, while the inner face of the inner wall (10) has an incline of between 0 and 15 degrees.

7. The device (100) according to claim 6, wherein the outer peripheral face (11) has an incline of between 9 and 13 degrees, while the inner face of the inner wall (10) has an incline of between 0 and 10 degrees.

8. The device (100) according to claim 5, wherein the at least one orifice (7) is arranged in the wall (8) opening at the edge (17).

9. The device (100) according to claim 1, wherein the intermediate chamber (6) is located at a periphery of the inlet for surrounding air (1).

10. The device (100) according to claim 1, wherein the intermediate chamber (6) is arranged in a rear position of the at least one intake chamber (3).

11. The device (100) according to claim 2, wherein the at least one orifice (7) comprises a passage made by a cutout in a periphery of the wall (8).

12. A device (100) for inflating at least one envelope (4), said device (100) comprising:

an inlet for surrounding air (1);

at least one non-return valve;

at least one compressed gas inlet (2);

at least one intake chamber (3);

at least one connection located along a longitudinal median symmetry axis (X, X'), provided as an extension of the at least one intake chamber (3), and connected to the at least one inflatable envelope (4);

an intermediate chamber (6) connecting at least one compressed gas inlet (2) to the at least one intake chamber (3);

wherein the intermediate chamber (6) and the at least one intake chamber (3) are separated by a wall (8) arranged transversely to the axis (X, X') and connected by at least one orifice (7) located in said wall (8), said wall (8) formed by an annular peripheral rib extending to an inner wall (10) of the at least one intake chamber (3); and wherein the intermediate chamber (6) comprises an inner side face of a wall joining a side wall (9) of the inlet for surrounding air (1), an outer lateral face of one wall comprising the at least one compressed gas inlet (2), and a transverse face of the wall (8) arranged in an extension of a transverse outer face (16) of an inner wall (10) of the at least one intake chamber (3).

13. The device (100) according to claim 3, wherein the intermediate chamber (6) comprises an inner side face of a wall joining a side wall (9) of the inlet for surrounding air (1), an outer lateral face of one wall comprising the at least one compressed gas inlet (2), and a transverse face of the wall (8) arranged in an extension of a transverse outer face (16) of an inner wall (10) of the at least one intake chamber (3).

14. The device (100) according to claim 5, wherein the outer peripheral face (11) has an incline of between 9 and 13 degrees, while the inner face of the inner wall (10) has an incline of between 0 and 10 degrees.

15. The device (100) according to claim 6, wherein the at least one orifice (7) is arranged in the wall (8) opening at the edge (17).

16. The device (100) according to claim 7, wherein the at least one orifice (7) is arranged in the wall (8) opening at the edge (17).

17. The device (100) according to claim 2, wherein the intermediate chamber (6) is located at a periphery of an inlet for surrounding air (1).

18. The device (100) according to claim 3, wherein the intermediate chamber (6) is located at a periphery of an inlet for surrounding air (1).

19. The device (100) according to claim 4, wherein the intermediate chamber (6) is located at a periphery of an inlet for surrounding air (1).

* * * * *